US006382554B1

(12) United States Patent
Hagelin

(10) Patent No.: US 6,382,554 B1
(45) Date of Patent: May 7, 2002

(54) METHOD FOR NAVIGATING A ROBOT AND ARRANGEMENT AT SAID ROBOT

(75) Inventor: Hans-Ove Hagelin, Linköping (SE)

(73) Assignee: Saab Dynamics AB, Linkoping (SE)

( * ) Notice: Subject to any disclaimer, the term of this patent is extended or adjusted under 35 U.S.C. 154(b) by 0 days.

(21) Appl. No.: 09/600,999

(22) PCT Filed: Jan. 20, 1999

(86) PCT No.: PCT/SE99/00070

§ 371 Date: Aug. 29, 2000

§ 102(e) Date: Aug. 29, 2000

(87) PCT Pub. No.: WO99/39149

PCT Pub. Date: Aug. 5, 1999

(30) Foreign Application Priority Data

Jan. 28, 1998 (SE) ..... 9800221

(51) Int. Cl.[7] ..... F41G 7/00
(52) U.S. Cl. ..... 244/3.15
(58) Field of Search ..... 244/3.15, 3.2

(56) References Cited

U.S. PATENT DOCUMENTS 5,082,200 A 1/1992 Gray
5,379,966 A * 1/1995 Simeone et al. ..... 244/3.11
5,762,290 A * 6/1998 Dupont ..... 244/3.15
6,259,974 B1 * 7/2001 Bessacini et al. ..... 114/20.1

FOREIGN PATENT DOCUMENTS

GB 2 279 444 A 1/1995

* cited by examiner

*Primary Examiner*—Peter M. Poon
*Assistant Examiner*—Kevin Jakel
(74) *Attorney, Agent, or Firm*—Connolly Bove Lodge & Hutz, LLP

(57) ABSTRACT

The present invention relates to an arrangement and a method for guiding a missile (1) towards a target (2). The missile has information on its own position, velocity vector and future velocity profile and continuously receives information on the position and velocity vector of the target. The invention is characterized in that from the information on the missile and the target a point of interception (A) is predicted at which the missile is expected to strike the target. A flight time is then calculated which indicates the time that it will take for the missile to travel to the predicted point of interception (A). In addition a fictitious point of interception (B) is calculated which is situated at a higher altitude than the predicted point of interception and the distance of which to that point is related to the calculated flight time. Finally the missile velocity vector is directed towards the said fictitious point.

7 Claims, 3 Drawing Sheets

METHOD FOR NAVIGATING A ROBOT AND ARRANGEMENT AT SAID ROBOT

The present invention relates to a method of guiding a missile towards a target according to the pre-characterising part of claim 1.

The present invention also relates to an arrangement in a missile for guiding the said missile towards a target according to the pre-characterising part of claim 4.

Several earlier methods of guiding a missile towards a target already exist. One method frequently encountered is so-called visual bearing guidance. Furthermore, there are methods of supplementing the visual bearing guidance with some function for enhancing the trajectory profile in the vertical plane for the purpose of obtaining increased performance. By means of this function the missile aims slightly higher than indicated by the line of sight, thereby producing a curvature of the missile trajectory.

U.S. Pat. No. 5,082,200 relates to a method of guiding a missile towards a point of interception with a target in the form, for example, of a satellite. A characteristic of the target, however, is that it has a known or predictable trajectory profile. The course of the missile is made to deviate from a collision course with the target by an angle dependent upon the distance to the target. The further the missile is from the target, the greater the angle of deviation.

This method is used for missiles propelled by solid fuel engines, in which the engines are fired at certain intervals and in which the engine constitutes the sole control element for guiding the missile.

One object of the present invention is to produce a method and an arrangement for guiding a missile towards a target that represent an improvement on the earlier known system described above.

The object has been achieved by means of a method for guiding a missile towards a target that has the characteristics specified in claim 1.

An arrangement for performing the said method has the characteristics specified in claim 4.

Preferred methods and embodiments also have any or some of the characteristics specified in the subordinate claim for each claim category.

The method and the arrangement according to the invention have various advantages:

- The missile is guided towards a point above the target in order to make use of the lower air resistance at higher altitude, with a view to optimising the trajectory of the missile in respect of any chosen criterion, for example maximum final velocity or maximum average velocity, or for the lowest possible fuel consumption. The latter may be utilised, among other things, if the missile calculates that it cannot reach the target by flying a straight trajectory, since the missile can climb to an altitude at which the fuel consumption is lower and in this way increase the range. Alternatively the missile maintains that altitude in order, simply via an active homing device, to activate the target's missile warning system for as long a time as possible.
- The missile can be manoeuvred on to a trajectory such that the kinematic performance of the missile is improved compared to previously known methods.
- As stated earlier, the method and the arrangement offer the freedom to select the optimisation criterion and final velocity conditions. In addition the trajectory of the missile can be adjusted as the scenario develops (interception point migration).
- The method and arrangement according to the invention permit speculation on target behaviour, such speculation being used in estimating the point of interception. In this way the target behaviour and thus the point of interception can be estimated, for example from knowledge of the type of target.
- An improved performance can be obtained in that the method and the arrangement can be used both in the trajectory phase of the missile and at least partially in its final phase.

The present invention will be described in more detail below with reference to the drawing, which shows an example of one advantageous embodiment.

Figure 1:
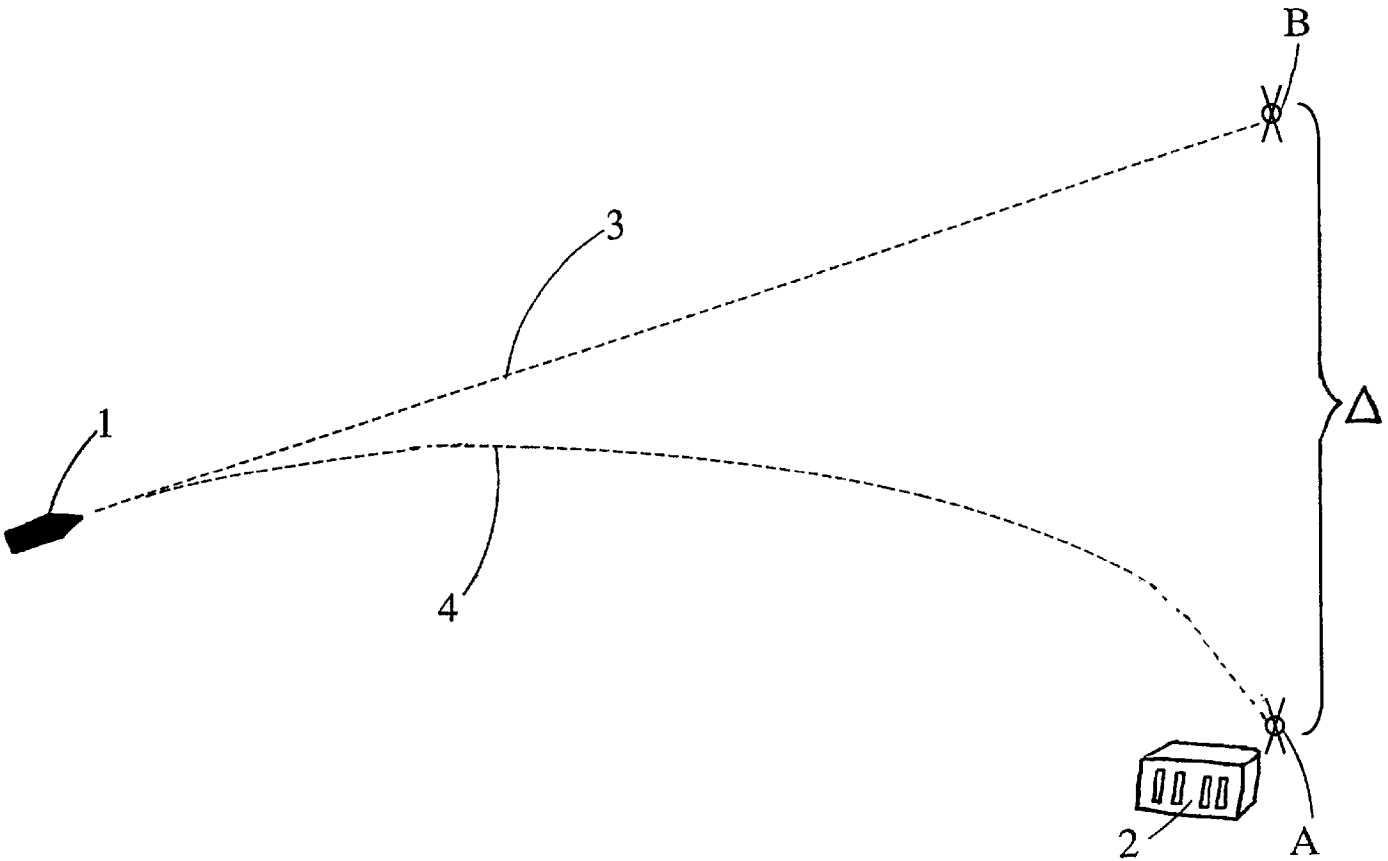
FIG. 1 shows a scenario in which a missile is steering towards a stationary target.

In FIG. 1, 1 denotes a missile and 2 denotes a stationary target. The missile 1 has information on its own position, velocity vector and the velocity characteristic during the continuous flight of the missile 1. Access to these data is obtained through use of previously known arrangements. For example, the missile, as in FIG. 3, has an inertial navigation system 6, via which information is obtained on the position and velocity vector of the missile. The characteristic for the continuous flight of the missile is obtained, for example, through a missile computer. In addition the missile has information on the position of the target, for example as in FIG. 3 via a homing device or communications link 7. The homing device may be an IR sensor or radar, for example.

Figure 3:
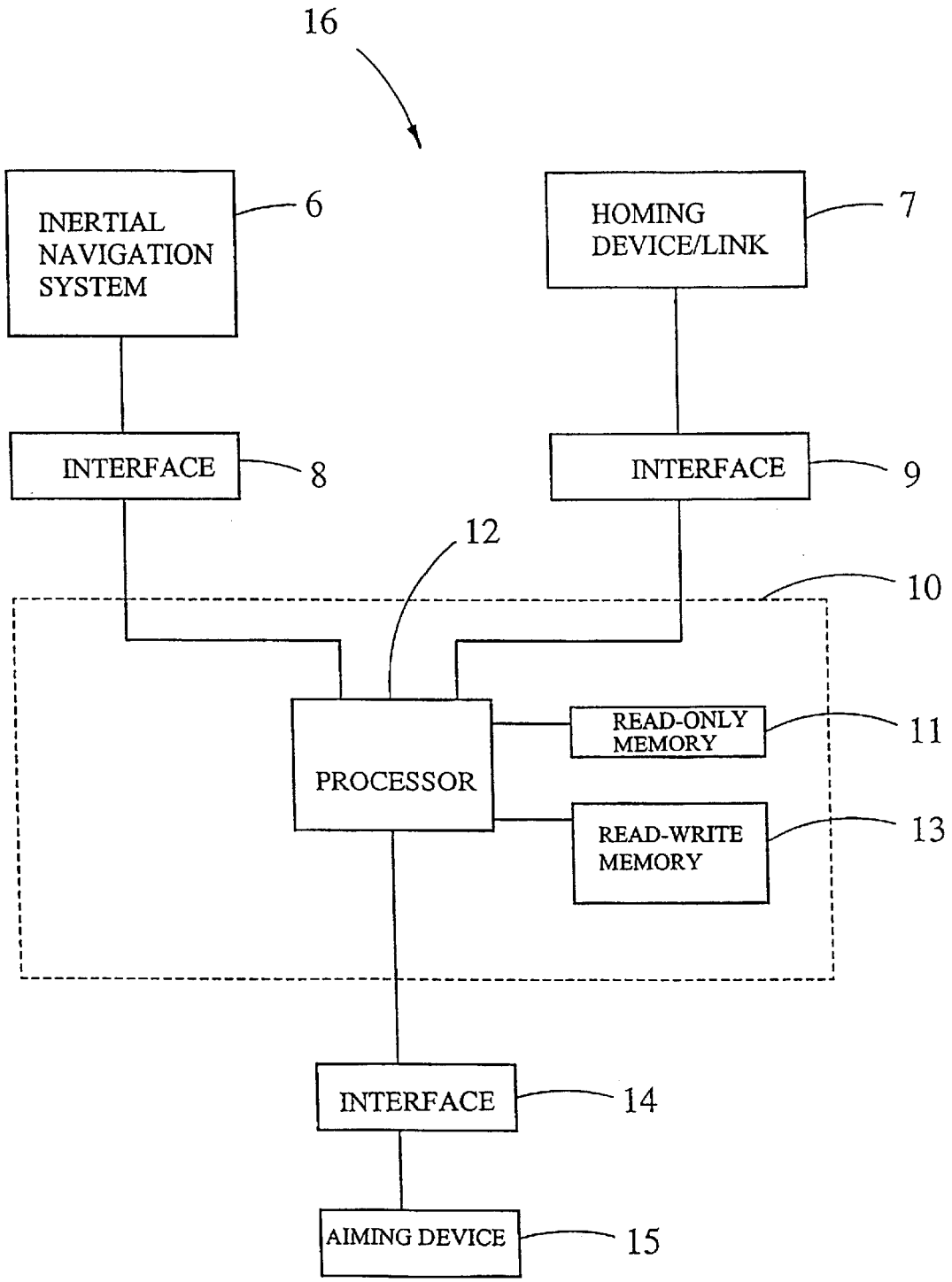
FIG. 3 shows an arrangement by means of which the missile guidance in FIGS. 1 and 2 is achieved.

The missile 1 on the missile trajectory is designed to continuously handle information on the missile 1 and the target 2, in order to guide the missile towards the target, which is situated at point A in FIG. 1. As shown in FIG. 3, the missile in one example has a read-only memory 11, in which software is stored, together with a processor 12, which is designed to carry out the instructions written into the software. The software is designed to read information on the missile and the target into a read-write memory 13 and from this information to calculate a flight time (ttg), which indicates the time it will take for the missile to travel to the target 2 by the shortest path. More precisely the flight time is obtained by resolving ttg from the following integral:

$$\int_{t1=0}^{t2=ttg} \hat{v}(t)dtts$$

where $\hat{v}(t)$ is the missile's further velocity characteristic and s is the distance between the missile and the target at t=0, where t=0 is the current position on the missile trajectory.

The software is furthermore designed to calculate a fictitious point, marked B in FIG. 1, which is situated at a higher altitude than point A and the distance of which to the latter is related to the calculated flight time (ttg), the missile velocity vector being kept directed towards the point B. In FIG. 1, Δ denotes the distance between point A and point B. Point B is preferably situated along a vertical line that passes through the point A.

As stated previously, the distance Δ is related to the calculated flight time (ttg). This relationship can be optimised with regard to the required characteristics of the missile trajectory. For example, the missile trajectory can be optimised so that the missile maintains the maximum average velocity and/or so that it has the maximum final velocity. This optimisation is performed by simulations carried out beforehand, in which account is taken of the characteristics and performance of the missile, and external factors, for example. In the simulations one or more parameters are developed for use by the missile by calculating the distance Δ between point A and point B. The distance Δ may be described, for example, by a polynomial, in which $$\Delta(ttg)=p_1*(ttg)^2+p_2*(ttg)+p_3$$

and in which the parameters $p_1$, $p_2$ and $p_3$ are estimated by the said simulations on the basis of a selected optimisation criterion. Note that this is only an example. Δ as a function of the flight time ttg need not be described by a polynomial. But Δ must decrease when the flight time decreases to approach zero as ttg approaches zero.

The position of the point B is continuously updated during the missile's trajectory towards the target 2 based on updated calculations of the flight time ttg performed on the basis of updated information on the position, velocity vector and further velocity characteristic of the missile. The missile velocity vector, which in an initial phase is directed as shown by the dashed line 3, will, as ttg diminishes, be directed closer and closer to point A. The dashed line 4 shows an example of a missile trajectory towards point A. It is characteristic of the missile trajectory that directing the missile velocity vector towards the fictitious point B, causes the missile to lob towards the target.

Figure 2:
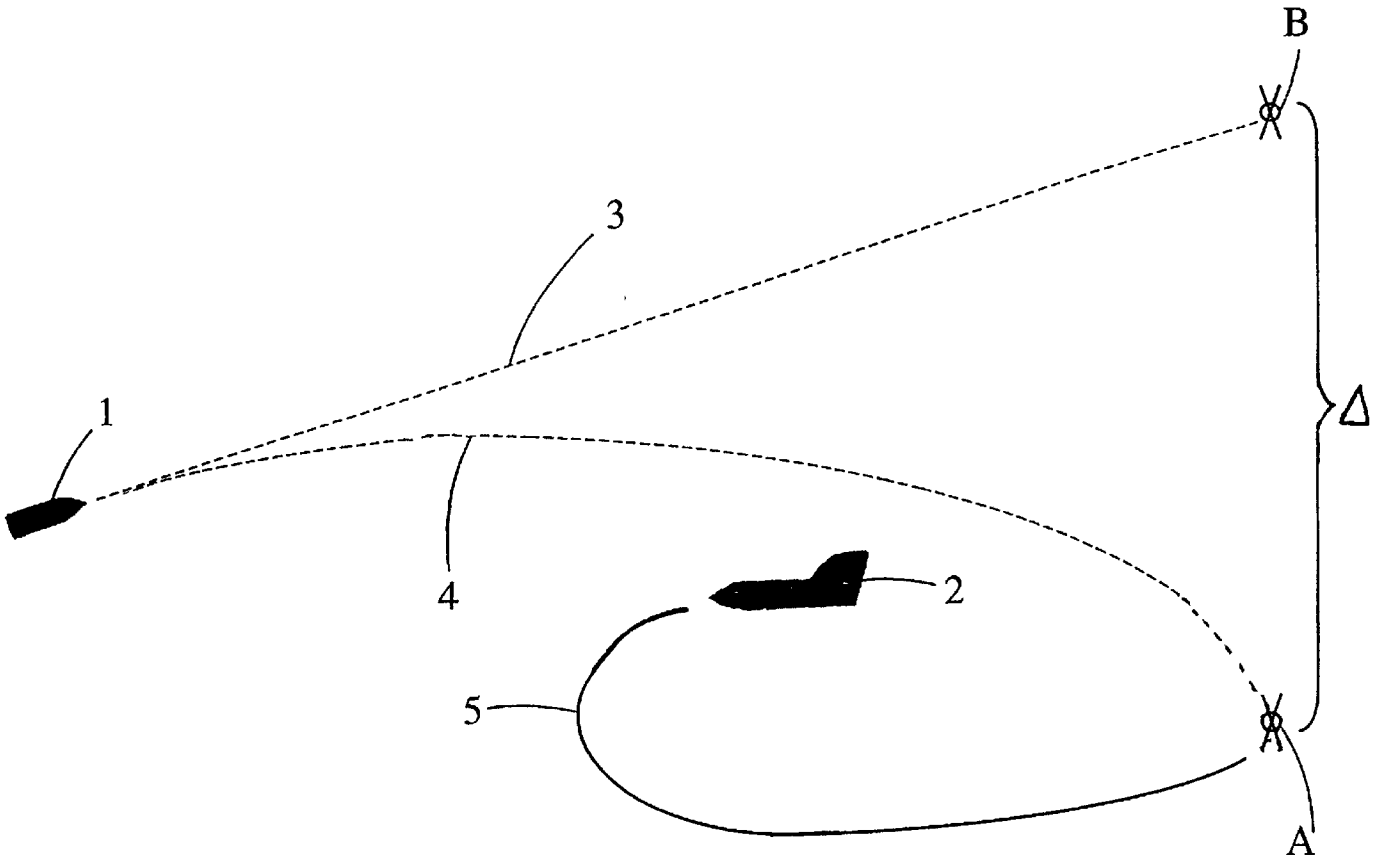
FIG. 2 shows a scenario in which the missile is steering towards a moving target in the form of an aircraft.

In FIG. 2, 1 denotes a missile and 2 denotes a target, as was the case in FIG. 1. Here, however, the target 2 is a moving target in the form of an aircraft. As described earlier, the missile 1 has information on its own position, velocity vector and the velocity characteristic during the continuous flight of the missile 1. In addition the missile continuously receives information on the position and velocity vector of the target. As stated previously, the missile I has software, which is stored in a read-only memory 11, a processor 12 designed to carry out the instructions written into the software and a read-write memory 13, into which information on the missile and the target is read. The software is designed, on the basis of the information read in, to predict a point of interception, marked A in FIG. 2, at which the trajectories of the missile 1 and the target 2 are simultaneously calculated to intersect and the missile is consequently expected to strike the target.

In this prediction use is made, on the one hand, of an assumption regarding future behaviour of the target in order to estimate the trajectory of the target, and on the other of a calculation of where along the estimated trajectory of the target the missile is calculated to strike on the basis of the missile's information on its own position, velocity and further velocity characteristic. The assumption regarding the future behaviour of the target can be made on the basis of a number of different factors. If the target is stationary, (as in FIG. 1) the solution becomes trivial, the target is assumed to be moving at a velocity 0. If the target is mobile it can be assumed to be moving with a constant velocity and direction, or with a constant velocity and constant radius of curvature, or the assumption can also be based on the premise that the target is being flown along the trajectory which makes it hardest for the missile to hit. In the latter case the missile is largely made to move towards the target in such a way that it will not miss the target, even if the target is manoeuvred so that its trajectory makes it as difficult as possible to hit.

When an assumption is made on future behaviour of the target, that is to say when the trajectory in which the target is assumed to continue has been determined, the point of interception A is predicted on the basis of this assumption of the future target behaviour. The prediction is made by an iterative process in order to find a point along the trajectory of the target, which the target and the missile can reach simultaneously, that is to say a point to which a flight time for the target $ttg_{target}$ is equal in length to a flight time for the missile $ttg_{missile}$.

A starting value $ttg_{target"start}$ is first assigned to $ttg_{target}$, following which it is calculated at what point along its trajectory the target will be at this point in time. The starting value $ttg_{target,\ start}$ may, for example, be stored beforehand in the read-only memory 16. It is then calculated what length of time the missile would need in order to reach the same point. We then call this time $ttg_{missile,\ start}$. If $ttg_{target,\ start}$ and $ttg_{missile,\ start}$ do not coincide, a new value is calculated for $ttg_{target}$, which we then call $ttg_{target,\ start+1}$. For example, $ttg_{target,\ start+1}$ is calculated as the mean value of $ttg_{target,\ start}$ and $ttg_{missile,start}$. The process above is then repeated n number of times until $ttg_{target,\ start+n}$ and $ttg_{missile,\ start+n}$ coincide or are sufficiently close to one another. We then have a value for the flight time ttg (i.e. $ttg=ttg_{target}=ttg_{missile}$), described in connection with FIG. 1, and the point at which the target and the missile are calculated to be at this time is the predicted point of interception A.

In addition the missile, as described earlier, is designed by means of the software to calculate a fictitious point of interception, denoted by B in FIG. 2, which is situated at a higher altitude than the predicted point of interception A and the distance Δ of which to that point is related to the calculated flight time (ttg). As previously, this indicates the time it will take the missile to travel to the predicted point of interception A by the shortest path and, where the target is a moving target, is obtained from the iterative process in order to predict the point of interception A, as described.

The velocity vector of the missile is kept directed towards the fictitious point of interception B. This is continuously updated during the missile's trajectory towards the target 2, based on the updated iterative calculations of the flight time (ttg) performed on the basis of the updated information on the missile and the target. In one embodiment the predicted point of interception A is updated once per second and the fictitious point of interception is updated more frequently, for example ten times per second. In this embodiment involving updates of the fictitious point of interception B in which the point of interception A is also updated, the flight time (ttg) is obtained when calculating the point of interception A, whereas in those updates of B in which A is not updated the target 2 is regarded as a stationary target, as described in connection with FIG. 1, the flight time (ttg) being calculated according to the description of the flight time calculation in connection with this figure.

In FIG. 2, 5 denotes an example of the target trajectory over a period up to the time when the missile strikes the target at the point of interception A. As stated previously, the predicted point of interception A should be updated as the information on the target and on the missile is updated and it has therefore shifted its position during the time up to impact.

FIG. 3 illustrates an arrangement 16, which has the elements that are needed for performing the examples of a method according to the present invention described above. As stated previously, the reference numbers 6 denote an inertial navigation system in the missile 1 and the reference numbers 7 denote a homing device in the missile 1 and/or a communications link. In one embodiment the missile's homing device 7 has a relatively short range, for which reason it can only be used in final phase guidance. When the missile is in the trajectory phase, it instead receives information on the target 2 via the communications link, for example with a firing aircraft. The said aircraft has a long-range radar and can therefore supply information on the target when the missile is in the trajectory phase. Then when the missile is so close to the target that its own radar will function, the aircraft can in this embodiment separate itself from the missile.

Furthermore there are interfaces 8 and 9 by means of which the information from the inertial navigation system 6 and the missile computer (not shown) and the homing device/the link 7 respectively can be read into the read-write memory 13 via the processor 12. The software in the read-only memory 11 contains instructions for predicting a point of interception at which the missile is expected to strike the target using the processor 12 on the basis of the information on the missile and the target previously referred to. In addition there are instructions for calculating the flight time. In the flight time calculation the distance s is calculated as the distance between the missile and the predicted point of interception at t=0, that is the current situation of the missile on its trajectory.

The software also has instructions for calculating the fictitious point of interception on the basis of the flight time obtained. In calculating the fictitious point of interception use is made of the parameters $p_1$, $p_2$, $p_3$ previously described, which are, for example, stored as constants in the program. The read-only memory 11, the processor 12 and the read-write memory 13 are located in a computer 10.

The arrangement 16 furthermore has an interface 14, via which the fictitious point of interception calculated in the computer program is converted to a form that an aiming device 15, connected to the interface 14, can use in order to direct the missile velocity vector towards the said fictitious point.

As stated previously, the system described here has applications in the trajectory phase and throughout or in part of the final phase.

What is claimed is:

1. Method for guiding a missile (1) towards a target (2), the missile having information on its own position, velocity vector and further velocity characteristic and continuously receiving information on the position and velocity vector of the target, characterised in that from the information which the missile has, a point of interception (A) is predicted at which the missile is expected to strike the target, a flight time is calculated which indicates the time it will take for the missile to travel to the predicted point of interception (A), from a given criterion for the trajectory characteristics of the missile a fictitious point of interception (B) is calculated, which is situated at a higher altitude than the predicted point of interception (A) and the distance (Δ) of which to the latter point is related to the calculated flight time and the missile is guided towards the said fictitious point.

2. Method according to claim 1, characterised in that the fictitious point of interception is situated along a vertical line that passes through the predicted point of interception.

3. Method according to claim 1, characterised in that the optimisation criterion is maximum final velocity.

4. An arrangement (16) in a missile (1) for guiding the latter towards a target (2), the missile having devices (6) designed to supply information on the missile's own position, velocity vector and further velocity characteristic, and devices (7) designed to continuously receive information on the position and velocity vector of the target, characterised in that the arrangement (16) has first calculating devices (11, 12) designed, on the basis of the information which the missile (1) has, to predict a point of interception (A) at which the missile is expected to strike the target, second calculating devices (11, 12) designed to calculate a flight time which indicates the time it will take for the missile to travel to the predicted point of interception (A), third calculating devices (11, 12) designed, on the basis of a given criterion for the trajectory characteristics of the missile, to calculate a fictitious point of interception (B) which is situated at a higher altitude than the predicted point of interception and the distance of which to that point is related to the calculated flight time and devices (15) designed to guide the missile towards the said fictitious point.

5. An arrangement according to claim 4, characterised in that the fictitious point of interception (B) is situated along a vertical line which passes through the predicted point of interception.

6. An arrangement according to claim 4, characterised in that the receiving device (7) is a homing device.

7. An arrangement according to claim 4, characterised in that the optimisation criterion is maximum final velocity.

* * * * *